United States Patent [19]

Ray

[11] 4,113,112

[45] Sep. 12, 1978

[54] CONSTANT BALANCE CRANE

[76] Inventor: Louis F. Ray, P.O. Box 14702, Baton Rouge, La. 70808

[21] Appl. No.: 714,228

[22] Filed: Aug. 13, 1976

[51] Int. Cl.[2] ..... B66C 19/00

[52] U.S. Cl. ..... 212/71; 212/48; 212/63

[58] Field of Search ..... 212/28, 12, 3, 39 R, 212/39 MS, 39 A, 47–49, 13, 56, 10, 63, 71, 11; 340/267 C; 214/142

[56] References Cited

U.S. PATENT DOCUMENTS

| | | | |
|---|---|---|---|
| 219,691 | 9/1879 | Coudaint-Gougeul | 212/49 |
| 654,739 | 7/1960 | Lancaster | 212/47 |
| 734,974 | 7/1903 | Shoosmith | 212/56 |
| 3,240,353 | 3/1966 | Leavesley | 212/49 |
| 3,642,148 | 2/1972 | Durand | 212/48 |
| 3,752,326 | 8/1973 | Levingston | 212/47 |

FOREIGN PATENT DOCUMENTS

| | | | |
|---|---|---|---|
| 1,323,411 | 2/1963 | France | 212/48 |
| 1,212,461 | 3/1960 | France | 212/48 |
| 1,949,456 | 4/1971 | Fed. Rep. of Germany | 212/48 |
| 1,905,257 | 8/1970 | Fed. Rep. of Germany | 212/56 |
| 496,772 | 8/1954 | Italy | 212/48 |
| 396,303 | 1/1974 | U.S.S.R. | 212/56 |

*Primary Examiner*—Robert G. Sheridan
*Assistant Examiner*—R. B. Johnson
*Attorney, Agent, or Firm*—Sughrue, Rothwell, Mion, Zinn and Macpeak

[57] ABSTRACT

A constant balance crane has a control tower and a plurality of gantry members mounted on the tower between its base and its upper section. Trolleys on the gantries are movably mounted, and a lift mechanism is provided on at least one trolley. On at least one other trolley a counterweight is carried. The lift and counterweight trolleys are propelled on the gantries by a hydraulic system or the like which is partially manual and partially automatically responsive to the downward moments on the gantry to adjust the counterweight trolley to a load balancing position, and to continuously adjust the counterweights relative to the load such that constant balance is maintained. In modified embodiments, the counterweight trolley travels in a horizontal plane that is vertically spaced from the plane of travel of the load trolley.

6 Claims, 13 Drawing Figures

CONSTANT BALANCE CRANE

BACKGROUND OF THE INVENTION

Field of the Invention

This invention relates to a lifting device employed to elevate an object, transfer it to a different location, and to lower and release it.

Statement of the Prior Art

It appears that the concept of balance of cranes has been recognized as a desirable objective, but that movements of counterweights on gantries or booms to accomplish this was not heretofore proposed.

SUMMARY OF THE INVENTION

This invention provides a constant balance crane particularly suited to those environments of use wherein a load must be lifted and tranported the full length of the crane gantry before release. Examples of situations wherein this occurs would include bulk material loading and unloading, factory uses, dockside applications, and the like. The present arrangement is such that the counterweight means hereof travels on a boom or gantry component independent of the lift means, thereby permitting a bypass or cross-over relation between the conveyed load and the counterweight.

In some embodiments of the invention, a plurality of counterweights, each movable in unison on independent gantry members, is provided. This lends additional stability and permits positioning of the weight-bearing member between the counterweights.

In other embodiments, unique by-pass rail systems are provided, allowing precise counterweights adjustment.

A hydraulic drive hereof includes tilt sensing means controlling operation of counterweight actuation, whereby constant balance is maintained during load transfer.

Other and further objects of the invention will become apparent to those skilled in the art from a consideration of the following specification when read in conjunction with the annexed drawings.

DESCRIPTION OF THE PREFERRED EMBODIMENTS

This invention pertains to the central concept of a balanced crane, other embodiments of which are shown in my prior applications Ser. No. 661,063 filed Feb. 24, 1976 for "Cable Stay Crane," Ser. No. 664,119 filed Mar. 5, 1976 for "Loading/Unloading Crane With Buoyant Counterweight System," and Ser. No. 668,996 filed Mar. 22, 1976 for "Barge Cable Crane."

Figure 1:
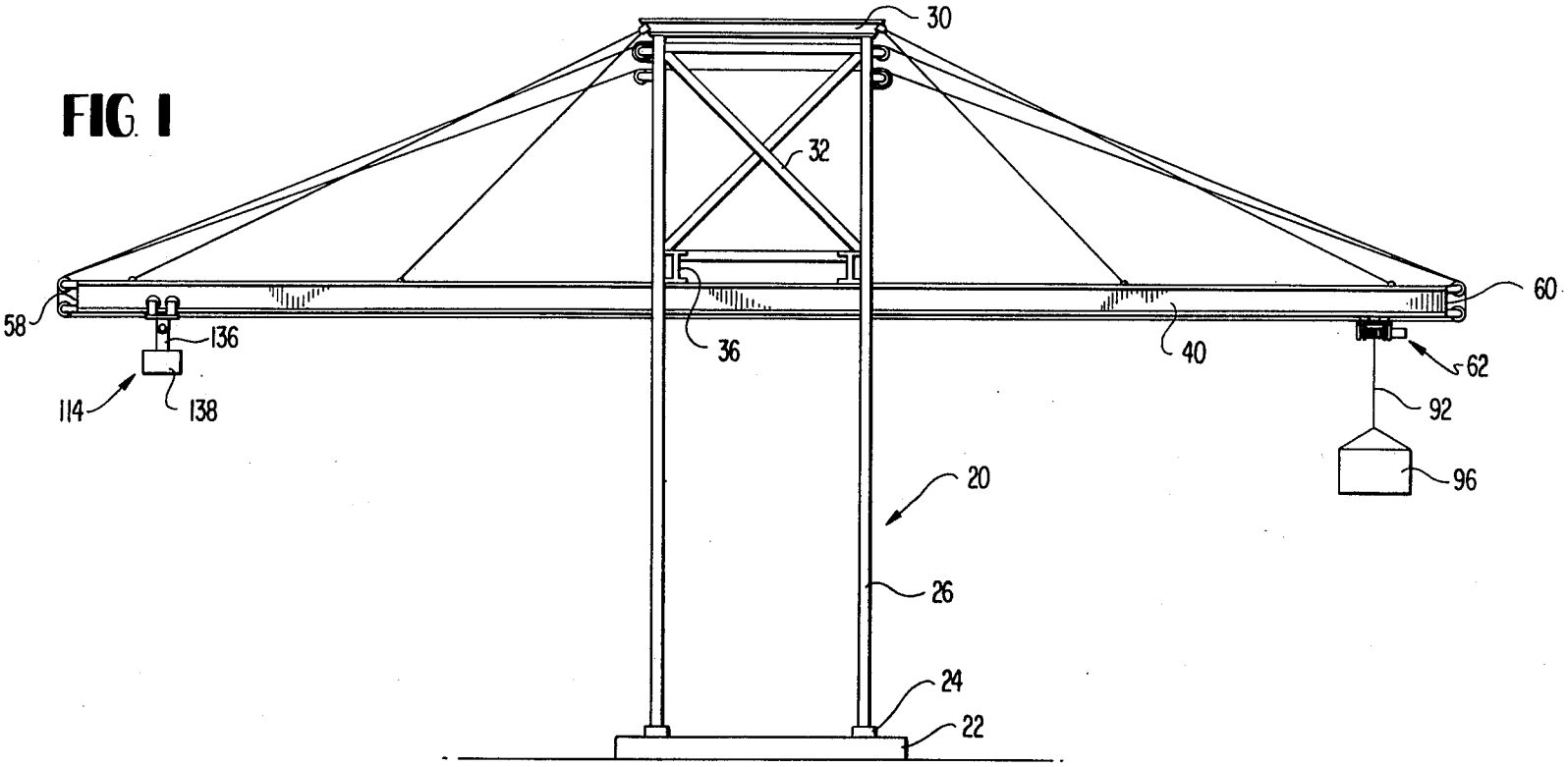
FIG. 1 is a side elevational view of a constant balance crane constructed and assembled in accordance with the teachings of this invention.
Figure 6:
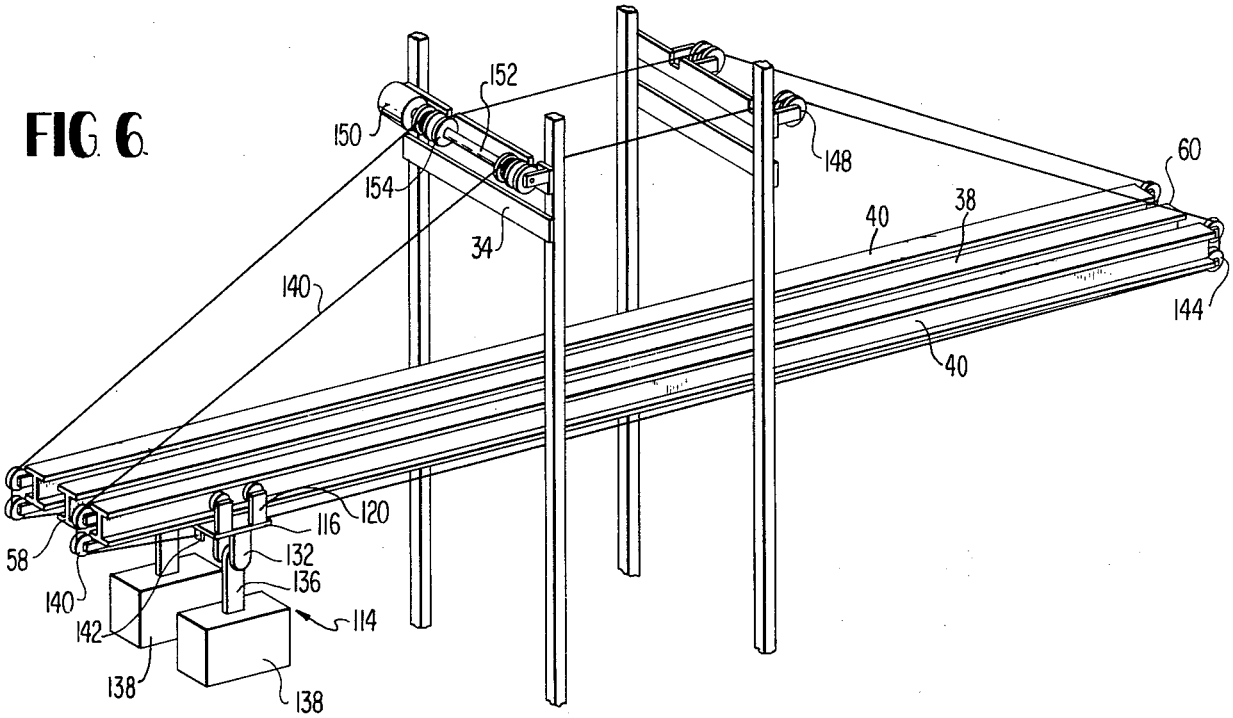
FIG. 6 is a perspective view of the crane, certain components being removed, to illustrate the counterweight mounting.
Figure 7:
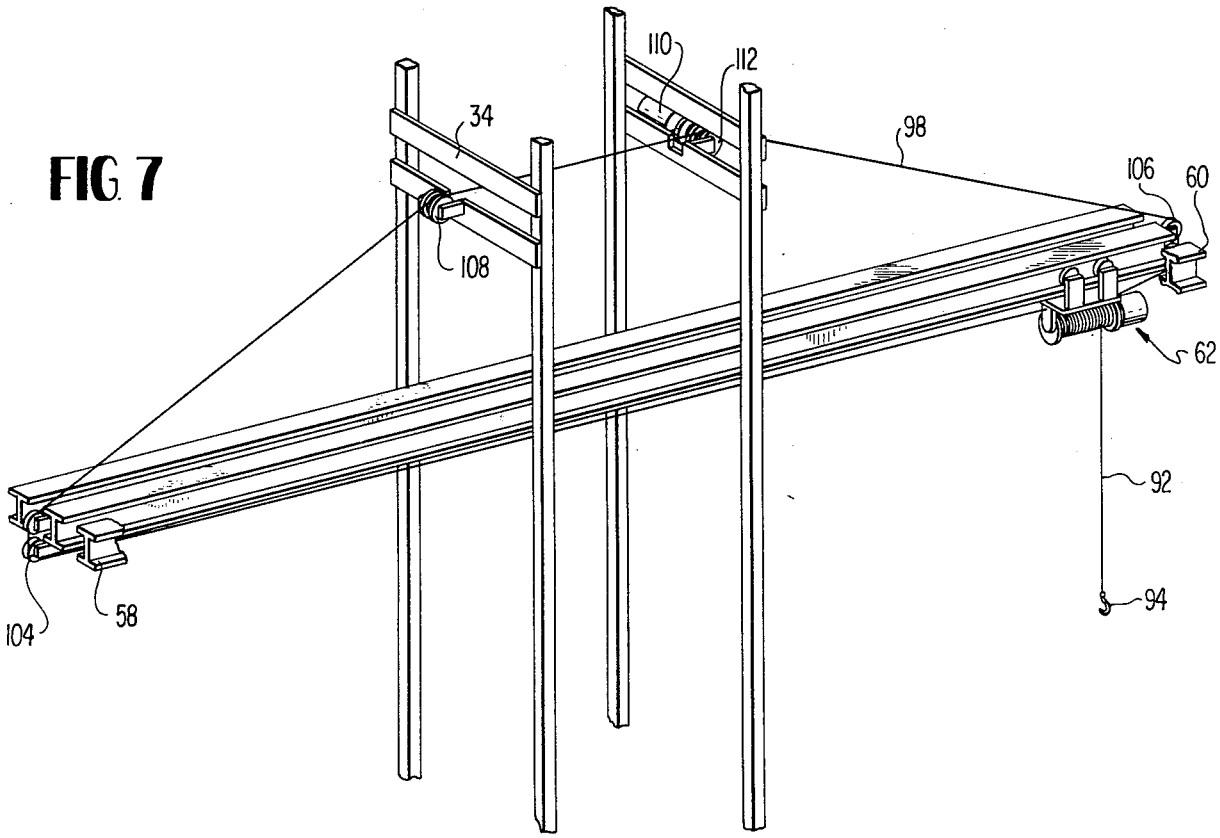
FIG. 7 is a view similar to FIG. 6, but partially broken away, and with other components removed to show the mounting of the lift trolley.

In FIG. 1 a constant balance crane according to this invention is identified generally by reference character 20. The crane mounting is of course variable according to employment, but illustratively has a base 22. Mounted in four hubs 24 (in a manner described below) on the base 20 are four posts or standards 26 which project vertically. These posts are joined together by beams 28 and 30 at their upper ends, and by diagonal braces 32. As shown in FIGS. 6 and 7, top cross brace members 34, in pairs, also connect the same. The columns are also connected by cross beams 36, and the columns, beams, girders and base provide a tower assembly for the crane.

Figure 2:
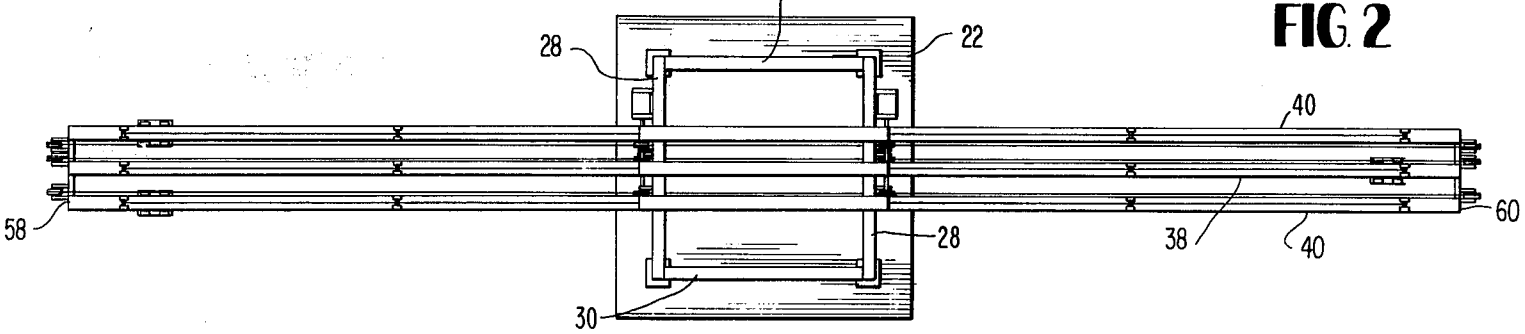
FIG. 2 is a top plan view thereof.
Figure 8:
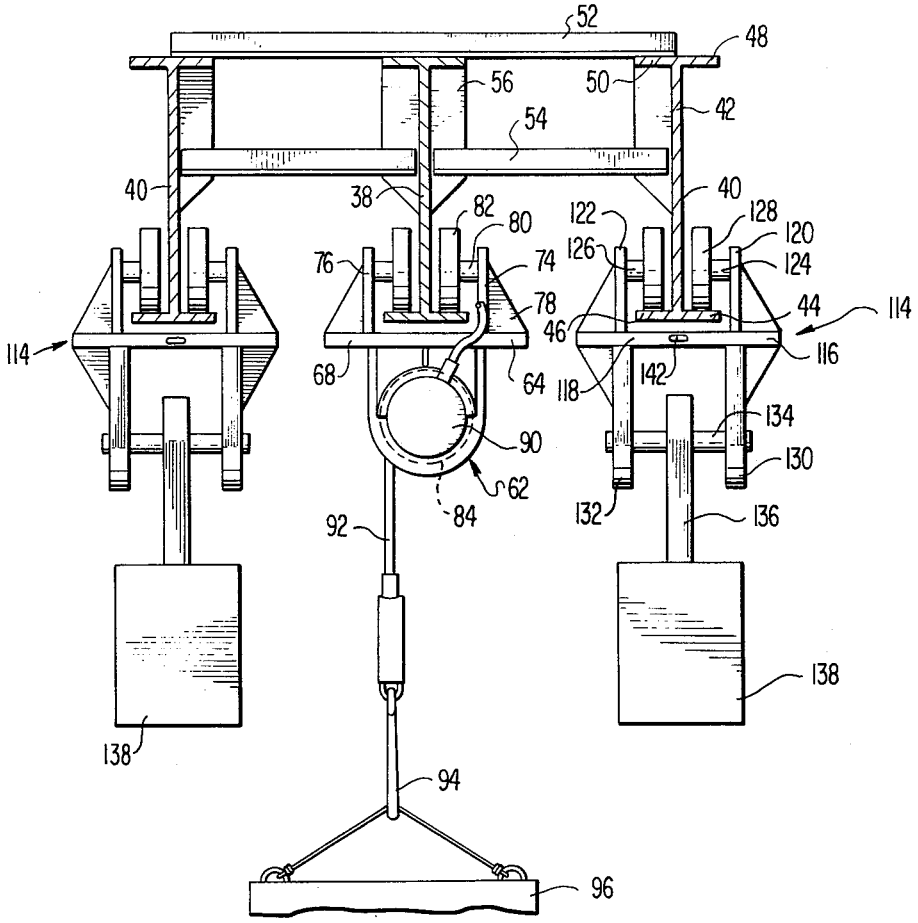
FIG. 8 is an enlarged sectional view through the gantry.

Securely mounted in horizontal fashion below the cross beam 36 is a plurality of gantry members, here including a central gantry 38 and outer gantries 40 (FIGS. 2, 7 and 8). Each comprises a heavy I-beam having a vertical central web 42, with outer lower ledges 44, 46 and upper ledge elements 48, 50 on either side thereof. The beams are fixedly secured to the cross beams 36 at their tops, and are also braced by suitable top plates 52 and interconnecting plates 54, with vertical tabs 56. The respective gantry members have outer ends 58 and 60.

Mounted for horizontal movement on the central gantry member 38 is a lift trolley assembly 62. The lift trolley includes a main trolley plate 64 having fore and aft ends 66, 68 and having depending front and rear brackets 70, 72 at said ends. Projecting from the sides of the plates are upward extensions 74 and 76 reinforcing by gusset plates 78. On the extensions are inwardly extending stub axles 80 on which wheels 82 are rotatably mounted. The wheels ride on the ledges 44 and 46 of the central gantry member.

Figure 9:
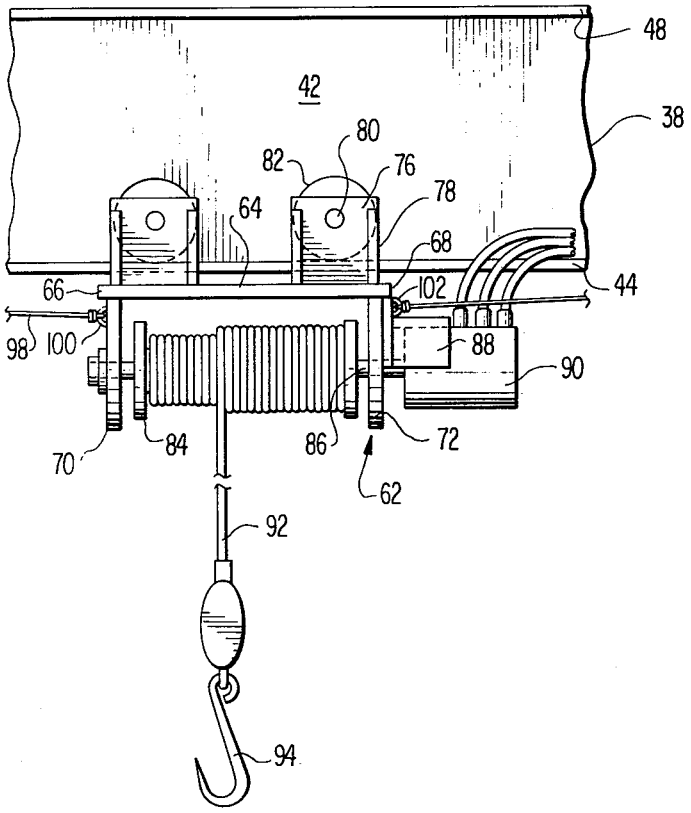
FIG. 9 is a side elevational view of the lift trolley assembly in place on its gantry member.

A cable drum 84 is positioned on a shaft 86 mounted in the brackets 70 and 72 (FIG. 9). A mount 88 secures a hydraulic cable motor 90, which rotates the drum to raise or lower a lift cable 92 with a hook 94 for the load 96 to be lifted.

Referring to FIGS. 7 and 9, it will be observed that a transport cable 98 is connected to the bracket 70 on an eye 100 at one end, and is also connected on an eye 102 at another end thereof. The cable is trained about pulley wheels 104, 106 mounted in pairs at the ends 58 and 60 of the gantry, and about an idler pulley 108 on a tower top cross beam 34. A trolley travel motor 110 has a drum 112 for driving the transport cable, and the motor is mounted on the opposite tower cross beam. The motor is of the reversible direction type, whereby the lift trolley may be propelled in either direction on the gantry by appropriate winding of the cable.

On the outer gantry members 40, which may be of any desired number, are movably mounted counterweight trolley assemblies 114. These are identical, and a description of one will cover all, the assemblies each having a horizontal body 116 with ends 118, and having a plurality of upstanding, spaced legs 120, 122 at its sides on opposite sides of the web of the associated I-beam. Stub axles 124, 126 project toward the web 40 from the legs, and carry rotatable wheels 128. The wheels 128 ride on the ledges 44 and 46. Side plates 130, 132 depend from the body 116, and are spanned by a cross shaft 134. A heavy bar 136 is suspended on the cross shaft, and has a weight 138 thereon.

FIG. 6 illustrates the means for movement of the counterweight trolleys 114. As there shown, a counterweight control cable 140 is secured to eyes 142 on both of the ends of the body portion 116. The cable is trained about idler pulley wheels 144, 146 on the gantry ends, and about an idler pulley 148 on one of the cross beams of the tower. On the opposite cross beam 34 is a hydraulic motor 150 with a shaft 152 having winding drums 154. As the motor is rotated in selected direction, the shaft turns, causing take up/pay out of the cable and moving the counterweights in unison on the gantries.

Figure 10:
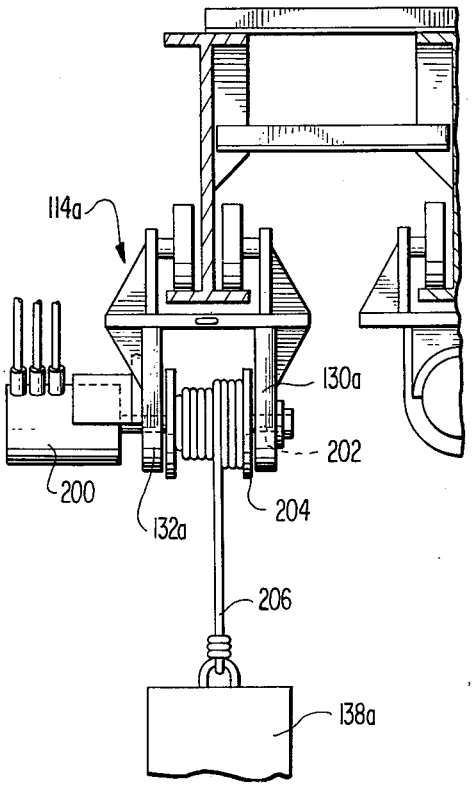
FIG. 10 is a view similar to FIG. 8, partially broken away, and showing a modification.

In FIG. 10, a modification is shown wherein the counterweight trolley **114*a* has a separate hydraulic motor 200 connected to a shaft 202 extending between the plates 130*a* and 132*a*. The shaft carries a reel 204 with a cable 206 which permits raising and lowering of the weight 138*a*** respectively, to raise and lower the center of gravity of the crane.

Figure 5:
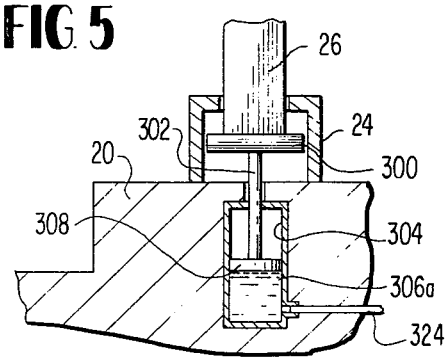
FIG. 5 is an enlarged cross-sectional view showing details through a column base of the crane tower.

As indicated above, FIG. 5 shows a base 22 for the crane having a series of hubs 24 for the posts 26. On the lower end of each post, within the hub, is a flange 300 with a rod 302. Formed in the base 22 is a chamber 304 with an embedded housing **306*a* into which the rod 302 extends. The rod carries a plunger 308 on its lower extremity, and a hydraulic line 324 extends from the lower end of the housing 206*a***.

Figure 4:
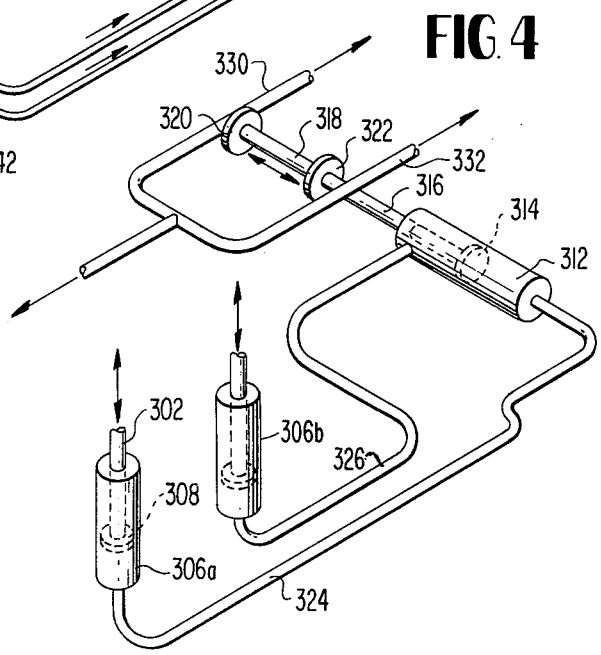
FIG. 4 is a schematic diagram of the tilt sensing and control valve means hereof.

FIG. 4 shows two of the tower post mounts in diagrammatic fashion. They are of side to side relationship, and in many instances, four such arrangements are employed. This description is limited to two post arrangements to avoid obscuring the purpose and structure of the unit. In FIG. 4, it will be observed that a line 324 or 326 extends from each of the side-by-side housing **306*a* and 306*b*, each of which has a plunger and a hydraulic line. These in turn are connected to a double-acting hydraulic cylinder 312 having an internal plunger 314. It will be recognized that a supply of hydraulic fluid is maintained within the system. As a load is placed on one of the posts 26 it creates a downward moment on the rod 302 associated therewith, and correspondingly reduces the pressure on the components of the other post of the system. This in turn forces hydraulic fluid from the chamber of the load bearing post and through the line 324 or 326 causing appropriate movement of the plunger 314 within the cylinder 312. This movement is transmitted through a shaft 315 having a hydraulic pinch valve 318 with two valve members 320 and 322. The valve 318 is positioned between a pair of hydraulic lines 330 and 332. The pinch valve members 320 and 322 are adapted to restrict the flow of hydraulic fluid through either the line 332 or the line 330** as shown.

Figure 3:
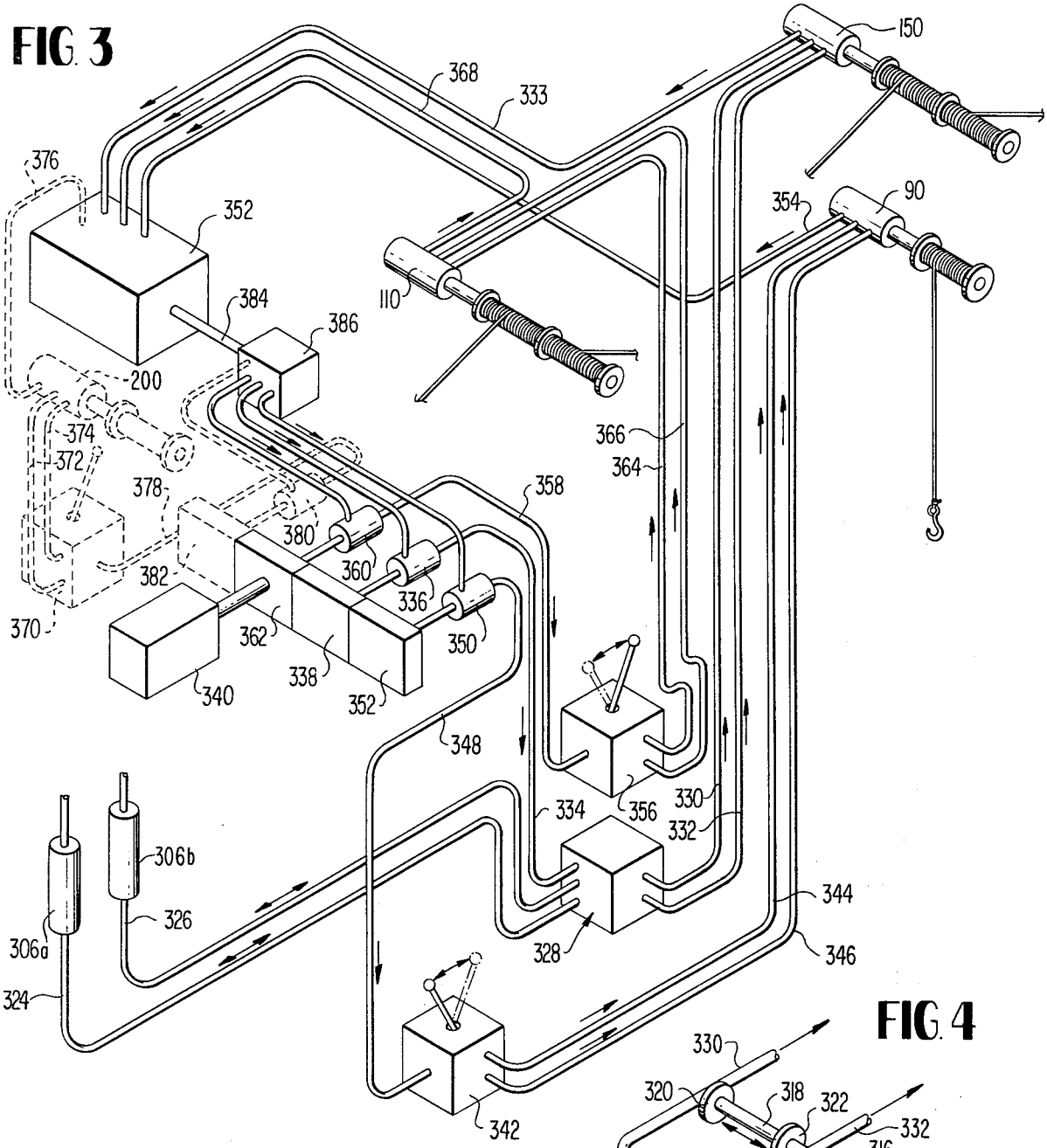
FIG. 3 is a schematic rendition of the hydraulic system hereof.

Referring to FIG. 3, the details of the sensor control of FIG. 4 are there omitted, but it will be observed that the lines 324 and 326 are shown. These lines lead to a proportional control valve as shown only in block form and identified by reference numeral 328. From the control valve 328 extend lines 330 and 332 which in turn extend to the motor 150 which propels the counterweights trolleys. Fluid from the motor is returned to a reservoir 352 by a return line 333. Means for supplying the hydraulic force to the proportional valve includes a line 334 to a prime mover 340. The prime mover 340 actuates the entire hydraulic system hereof.

With continued reference to FIG. 3, reference numeral 342 identifies a manual control for the lift mechanism. The manual control has output lines 344 and 346 extending to the motor 90 of the lift mechanism. The manual control has an input line 348 extending to a pump 350 connected to a gearbox 352 of the gearbox bank. Fluid from the motor is returned to the reservoir 352 by a hydraulic return line 354 from the motor.

A second manual control valve 356 is provided for movement of the lift trolley. It is supplied by a line 358 extending to a pump 360 and gearbox 362 of the bank of gearbox controls. Extending from the second manual control are lines 364, 366 which control the operation of the trolley motor 110. Fluid from the motor 110 is returned to the reservoir 352 through a return line 368.

From the foregoing, it will be clear that as the operator, through actuation of the manual control 356, moves the lift trolley across the gantry, the tilt moment applied to the gantry by the load is sensed by the posts and this in turn is transmitted via the hydraulic lines 324 and 326 and pinch valve 318 to activate the proportional control 328 and propel the counterweight trolleys in the selected direction.

The phantom lines in FIG. 3 illustrate a further manual control 370 which is used with the modification previously discussed and shown in FIG. 10 of the drawing. This is simply another manual control, and it will be observed that it includes lines 372 and 374 extending to the motor 200. A return line 376 returns fluid to the reservoir 352 where this is used, and a supply line 378 extends back to a pump 380 with a gearbox 382 embodied in the gearbox bank. It will also be noted generally that the supply for the fluid is transmitted through a line 384 from the reservoir through a distributor valve 386 which, through appropriate connections, supplies each of the hydraulic pumps.

Figure 11:
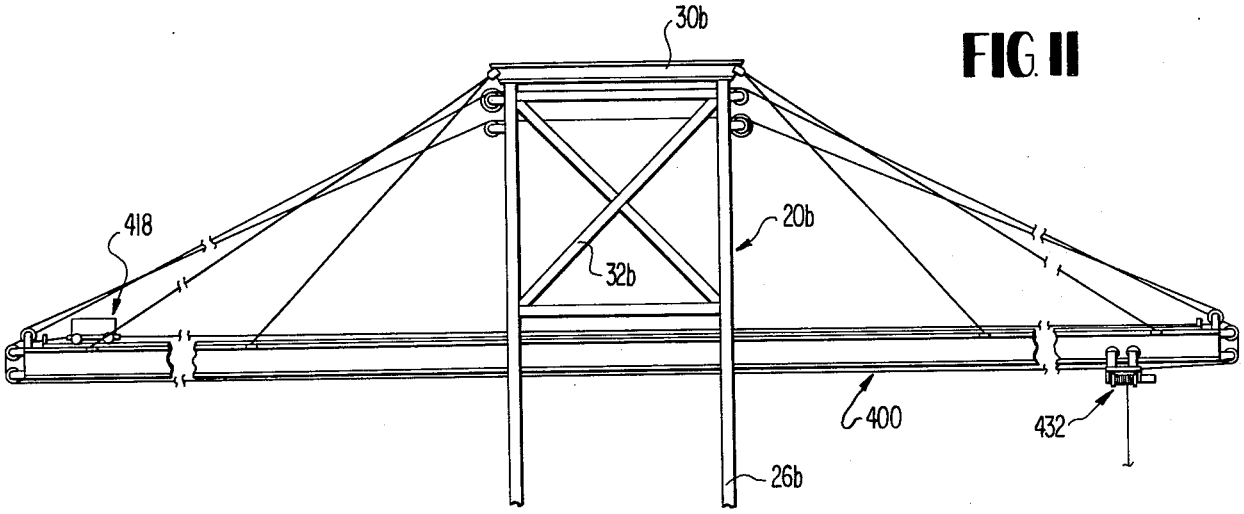
FIG. 11 is a side elevational view showing another modification.
Figure 12:
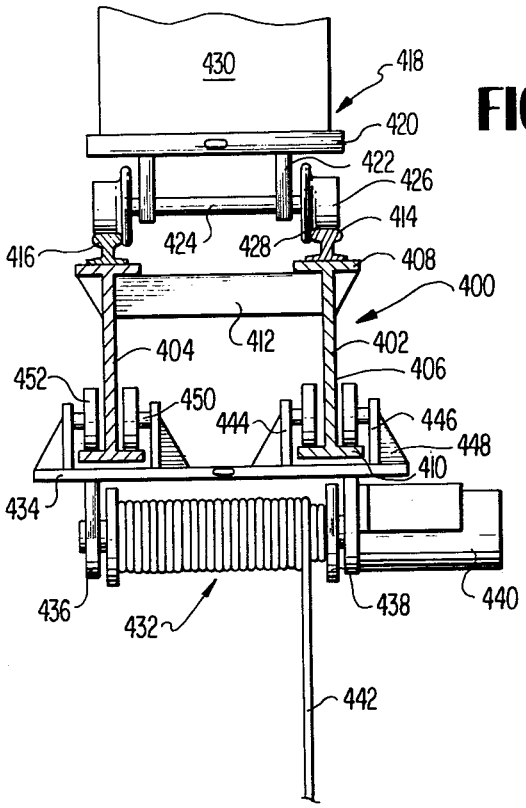
FIG. 12 is an enlarged vertical cross section through the gantry of the FIG. 11 embodiment.

In FIG. 11, a tower **20*b* has top beams 30*b* and diagonal braces 32*b*. Horizontally mounted below the braces on the tower by means extending from the column 26*b* is a gantry 400. Referring to FIG. 12, it will there be observed that the gantry 400 includes parallel I-beams 402 and 404**.

The beams 402 and 404 each have a central rib 406 and top and bottom flanges 408 and 410. At spaced locations, the beams are connected together by cross braces 412.

Fixedly secured on the top flanges 408 are longitudinally extending rail members 414, 416. A counterweight truck or trolley 418 has a bed 420 with depending bearings 422, and axles 424 extend through the bearings. Railroad-type wheels 426 having inside flanges 428 are provided on the axles and permit the counterweight truck to ride on the rails. A box 430 on the bed is used as a container for counterweight material. The counterweight truck is movable on the gantry through propulsion means of the type described in connection with the first forms of the invention.

A lift trolley 432 for this form of the invention comprises a trolley plate 434 having depending brackets 436 supporting a winch 438 and motor 440 for a lift cable 442. From the top of the plate 434 extend pairs of uprights 444, 446, braced by gusset plates 448. These carry stub axles 450 on which roller wheels 452 are rotatably mounted. These wheels ride on the ledges provided by the bottom flanges 410. Propulsion of the lift trolley is also as described above in connection with the other forms of the invention.

Thus, in this form of the invention the counterweight trolley by-passes the load trolley in overhead fashion. Operation is otherwise as described above.

Figure 13:
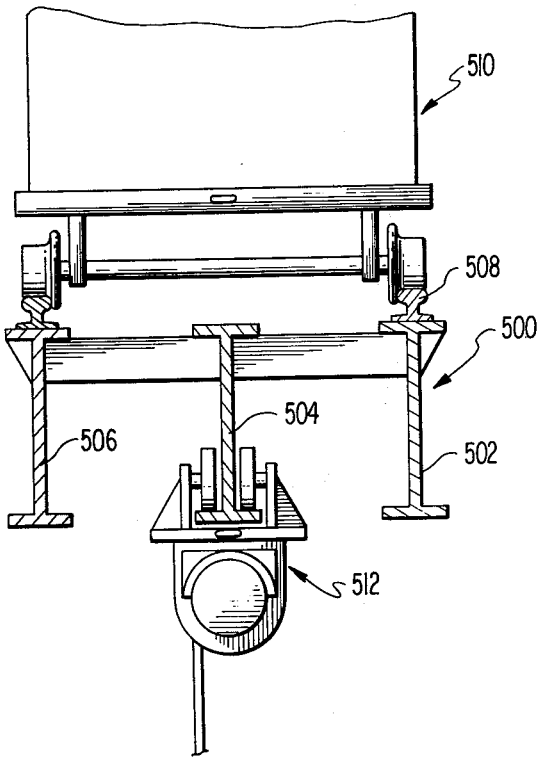
FIG. 13 is a view similar to FIG. 12 showing another modification.

FIG. 13 shows yet another embodiment wherein the gantry 500 is composed of three I-beams 502, 504 and 506. The rails 508 for the counterweight trolley 510 are fixedly secured on the outer I-beams 502 and 506, while the load trolley 512 is mounted on the central I-beam 504.

I claim:

1. A constant balance crane comprising:

a tower assembly including a base and two pairs of vertical standards projecting from said base, the tower assembly further including an upper section comprising cross beams interconnecting the standards of said pairs, top cross braces, and reinforcing girders;

a plurality of substantially horizontal gantry members secured to the tower under said cross beams, including a central gantry member, and outer gantry members;

each of said gantry members being of I-beam form and having a central web with outer ledges on either side of the web;

a lift trolley assembly movably mounted on said central gantry, and including a trolley plate with spaced-apart upward extensions at either side thereof, axles extending inwardly from said upward extensions, and wheels rotatably mounted on said axles and contacting the outward ledges of the central gantry member, depending front and rear brackets, a shaft mounted between the front and rear brackets, a drum rotatably mounted on said shaft, a hydraulic lift motor for rotating said drum, and a lift cable on the drum;

means for propelling said lift trolley assembly horizontally on the central gantry member comprising a cable secured to the ends of the trolley assembly, cable pulley wheels on each end of the gantry, an idler pulley wheel on one of said top cross braces, a first hydraulic trolley motor with a drive drum on an opposite top cross brace, the cable passing over the cable wheels on the gantry end and also passing over the idler pulley, and the cable being secured on said drive drum, whereby actuation of the motor results in movement in selected direction of the trolley on the central gantry;

the outer gantry members having movable counterweight trolleys thereon; each of said counterweight trolleys comprising a horizontal body having upstanding, spaced legs on either side of the ledges of the associated I-beam, stub axles, wheels rotatably mounted on said stub axles, said wheels riding on said ledges, and a weight member suspended from the horizontal body;

means for propelling said counterweight trolleys in unison along said outer gantry members and comprising cable pulleys on each end of the outer gantry members, a pair of cables, one for each trolley, a double drum reel mounted on one of said cross beams of said tower upper section, an idler pulley mounted on another of said cross beams, each cable being connected at one end to the trolley and at its other end to said double drum reel and being trained about said cable and idler pulleys, and a second hydraulic trolley motor driving said double drum reel, whereby actuation of the last-named motor results in movement of the counterweight trolleys in unison in selected directions on the outer gantries; and control means including manually operated controls for the lift motor, manually operated controls for the first hydraulic trolley motor operating the lift trolley assembly, and automatic controls for the second hydraulic trolley motor to move the counterweight trolleys in a direction opposite to the movement direction of the lift trolley to maintain the crane in balance.

2. A constantly balanced crane comprising:

a tower assembly having an upper section and a base;

a horizontal gantry secured at a point intermediate its ends to the tower assembly between the base and the upper section;

a plurality of track means extending substantially the full length of said gantry and through the center of said tower assembly and supporting a plurality of trolleys for bi-directional horizontal movement between the ends of said gantry and through the center of said tower assembly;

at least one of said trolleys being a lift trolley and having a lift mechanism for hoisting and lowering of objects to be moved;

at least one of the trolleys being a counterweight trolley and having a counterweight;

the trolleys each being horizontally movable in both directions through said intermediate point substantially the full length of the respective track means on which they are supported;

means to drive each of said trolleys along its respective track means;

separate manually actuated control means to activate said lift mechanism and to control horizontal movement of said lift trolley; and sensor means responsive to downward moments on the gantry occasioned by the load on the lift mechanism to actuate said drive means to horizontally move the counterweight to balance position so that the moments on both sides of the tower assembly are substantially equal, and for adjusting the counterweight to a horizontal position on either side of said tower assembly, during movement of the lift mechanism trolley along the length of its respective track means, to maintain said moments equal independently of the weight of the load and position of the lift trolley.

3. A constant balance crane as defined in claim 2, wherein said sensor means comprises means for sensing the tilt of the tower assembly.

4. A constant balance crane as defined in claim 2, wherein said track means comprises a plurality of parallel, horizontally-spaced track members, each supporting a different one of said trolleys.

5. A constant balance crane as defined in claim 2, wherein said track means comprises two track members mounted one above the other, each track member supporting a different one of said trolleys.

6. A constant balance crane as defined in claim 3, wherein said drive means comprises an hydraulic fluid motor, and said sensor means comprises hydraulic fluid control means associated with said base of said tower assembly for controlling said hydraulic motor in accordance with the tilt of said tower assembly to drive said counterweight trolley to said horizontal position to balance said moments.

* * * * *